US011097438B2

(12) United States Patent
Guynn et al.

(10) Patent No.: US 11,097,438 B2
(45) Date of Patent: Aug. 24, 2021

(54) ADJUSTABLE WEIGHT STRIKING DEVICE

(71) Applicant: TECH SWERVE, LLC, Salt Lake City, UT (US)

(72) Inventors: John M. Guynn, Salt Lake City, UT (US); Branden D. Rosenhan, Salt Lake City, UT (US)

(73) Assignee: TECH SWERVE, LLC, Salt Lake City, UT (US)

( * ) Notice: Subject to any disclaimer, the term of this patent is extended or adjusted under 35 U.S.C. 154(b) by 692 days.

(21) Appl. No.: 14/209,859

(22) Filed: Mar. 13, 2014

(65) Prior Publication Data

US 2014/0259695 A1 Sep. 18, 2014

Related U.S. Application Data

(60) Provisional application No. 61/798,510, filed on Mar. 15, 2013.

(51) Int. Cl.
*B26B 23/00* (2006.01)
*B25D 7/00* (2006.01)
*B25D 1/02* (2006.01)

(52) U.S. Cl.
CPC ..... *B26B 23/00* (2013.01); *B25D 1/02* (2013.01); *B25D 7/00* (2013.01); *B25D 2250/005* (2013.01); *B25D 2250/391* (2013.01)

(58) Field of Classification Search
CPC ..... B25D 7/00; B25D 1/02; B25D 2250/005; B25D 2250/391; B26B 23/00
USPC ..... 81/20–22, 25–26
See application file for complete search history.

(56) References Cited

U.S. PATENT DOCUMENTS 661,717 A * 11/1900 Hawes ..... B25D 1/04 254/26 R
1,674,999 A * 6/1928 Sewell ..... B25D 1/02 81/19
1,792,153 A * 2/1931 Evich ..... B25D 1/02 81/20

(Continued)

OTHER PUBLICATIONS

Royal Society of Chemists; https://www.rsc.org/periodic-table/element/22/titanium.*

(Continued)

*Primary Examiner* — Monica S Carter
*Assistant Examiner* — Marcel T Dion
(74) *Attorney, Agent, or Firm* — Workman Nydegger

(57) ABSTRACT

Adjustable weight striking device can be selectively loaded with weighting material to temporarily increase striking force during use and unloaded to reduce weight while carrying. The tool has body made of low density material and working end for striking tool, handle extending from the body made of low density material, striking tool at working end, and apparatus for holding weighting material adjacent to the body. The weight holding apparatus can be platform with straps or other securing feature for temporarily holding weighting material and/or an interior chamber within the body for receiving weighting material. Weighting material can be sand, water, dirt, gravel, rock, or metal and can temporarily increase the weight of the striking tool by 50%, 100%, 200% 250%, 300%, 400%, 500% or more depending on volume and/or density of weighting material as compared to striking device.

19 Claims, 14 Drawing Sheets

(56) References Cited

U.S. PATENT DOCUMENTS 2,604,914 A * 7/1952 Kahlen ..... B25D 1/02 81/19
2,763,172 A * 9/1956 Richards ..... B21D 1/06 72/482.94
3,580,312 A * 5/1971 Hallock ..... B25D 1/06 81/24
3,605,832 A * 9/1971 Stephens ..... B25D 1/02 81/25
3,823,430 A * 7/1974 Welsh, II ..... B25F 1/00 7/146
3,896,864 A 7/1975 Green et al.
4,039,012 A * 8/1977 Cook ..... B25G 1/01 81/22
4,287,623 A * 9/1981 Tarran ..... B23D 29/02 7/158
4,784,027 A * 11/1988 Hatch, III ..... B21D 1/06 29/254
4,803,023 A 2/1989 Enomoto et al.
4,876,928 A 10/1989 Gaulin
4,911,434 A * 3/1990 Herring ..... A63B 21/065 482/105
5,102,123 A * 4/1992 Roark ..... A63B 21/4001 482/105
5,216,939 A * 6/1993 Swenson ..... B25D 1/02 81/20
5,255,575 A * 10/1993 Williams ..... B25D 1/02 81/25
5,375,486 A * 12/1994 Carmien ..... B25G 3/12 81/21
5,399,135 A * 3/1995 Azzouni ..... A63B 21/072 482/106
5,408,902 A * 4/1995 Burnett ..... B25D 1/12 30/308.1
5,484,367 A * 1/1996 Martinez ..... A63B 21/0728 482/107
5,537,896 A 7/1996 Halder
D388,848 S * 1/1998 Sontz ..... D21/679
6,106,755 A * 8/2000 Pfoertner ..... B25D 1/08 264/135
6,332,376 B1 * 12/2001 Hurley ..... B25C 11/00 7/144
6,435,059 B1 * 8/2002 Martinez ..... B25D 1/06 30/308.1
6,505,117 B1 * 1/2003 Ratert ..... G01C 21/3446 701/455
6,536,308 B1 * 3/2003 Thorne ..... B25D 1/02 81/20
6,655,236 B1 * 12/2003 Slack ..... B25D 1/02 81/20
8,104,379 B2 * 1/2012 Hanlon ..... B25D 1/045 7/143
8,141,458 B1 * 3/2012 Spencer ..... B25D 1/02 81/20
9,044,846 B1 * 6/2015 Dawson ..... B25D 1/00
9,149,922 B1 * 10/2015 Vazikas ..... B25D 1/00
10,183,389 B1 * 1/2019 Annunziata ..... B25D 1/10
2001/0032366 A1 * 10/2001 Rowland ..... B25D 1/04 7/143
2003/0042474 A1 * 3/2003 Boydon ..... B25D 1/045 254/25
2004/0159189 A1 * 8/2004 Luton ..... B25D 1/00 81/20
2005/0115365 A1 * 6/2005 Nau ..... B25D 1/14 81/26
2006/0090605 A1 * 5/2006 Fisher ..... B25F 1/00 81/25
2007/0113709 A1 * 5/2007 Krallman ..... B25D 1/045 81/22
2007/0129163 A1 * 6/2007 Solari ..... A63B 53/0487 473/336
2009/0176126 A1 * 7/2009 Kao ..... B32B 15/013 428/649
2013/0025102 A1 * 1/2013 Barnhart ..... B25G 3/26 29/239
2014/0051554 A1 * 2/2014 Walker ..... A63B 15/00 482/109
2015/0251302 A1 * 9/2015 Flosi ..... B25D 1/12 81/25

OTHER PUBLICATIONS

NIST; https://physics.nist.gov/cgi-bin/Star/compos.pl?matno=906.*
U.S. Appl. No. 13/568,769, filed Aug. 7, 2012, Dawson et al.
U.S. Appl. No. 13/568,769, filed Jul. 15, 2014, Office Action.
Coleman Mallet with Peg Remover: Amazon Sports & Outdoors, http://www.amazon.com/Coleman-Mallet-with-Peg-Remover/dp/B001U9CWP6/ref=pd_si . . . , (Accessed Aug. 31, 2012).
Liberty Mountain Tent Peg Mallet/Puller: Amazon.com: Sports & Outdoors, http://www.amazon.com/dp/B001H3R7YG/ref=asc_df_B001H3R7YG2161285?smid=A1 . . . (Accessed Aug. 31, 2012).
Mallet Free Tarp Pegs/Spikes? Hammock Forums—Elevate Your Perspective, http://www.hammockforums.net/forum/showthread.php?t=51609 (Accessed Aug. 31, 2012).
Coghlan's Tent Peg Mallet & Puller: Amazon.com: Sports & Outdoors, http://www.amazon.com/Coghlans-Tent-Peg-Mallet-Puller/dp/B000E24HKS/ref=pd_sim_ . . . (Accessed Aug. 31, 2012).
Coghlans 9742 Plastic Tent peg Mallet: Amazon.com: Sports & Outdoors, http://www.amazon.com/Coghlans-9742-Plastic-Tent-Mallet/dp/B001QBZIMC/ref=pd_si . . . (Accessed Aug. 31, 2012).
Dead blow hammer—Wikipedia, the free encyclopedia; http://en.wikipedia.org/wiki/Dead_blow_hammer (Accessed Aug. 31, 2012).
Zombie Squad, What is the best improvised camp hammer—Here are my ideas, http://zombiehunters.org/forum/viewtopic.php?f=14&t=90328 (Accessed Aug. 31, 2012).
Halfbakery: Adjustable Weight Hammer, http://www.halfbakery.com/idea/Adjustable_20Weight_20Hammer (Accessed Aug. 31, 2012).
SISU War Hammer Is a Weight-Adjustable Sledgehammer for Core Training, http://www.coolthings.com/sisu-war-hammer/ (Accessed Aug. 31, 2012).
IB:Topic:Water Filled Mallet, Backpacker, http://forums.backpacker.com/cgi-bin/forums/ikonboard.cgi?act=ST;f=8321 . . . (Accessed Sep. 28, 2012).

* cited by examiner

ADJUSTABLE WEIGHT STRIKING DEVICE

CROSS REFERENCE TO RELATED APPLICATION

This application claims the benefit of U.S. Provisional Application No. 61/798,510, filed Mar. 15, 2013, the disclosure of which is incorporated herein in its entirety.

BACKGROUND OF THE INVENTION

1. Field of the Invention

The invention is in the field of striking devices, such mallets, hammers, hatchets, axes, ice axes, picks, and the like for use in striking an object or surface.

2. Relevant Technology

Camping mallets are often used to drive in tent stakes and can be made of molded plastic so as to be both rigid and lightweight. An example camping mallet is illustrated in FIG. 1. FIG. 1 shows a lightweight camping mallet 100 molded from plastic that includes a head 102 and a handle 104. Handle 104 includes holes 106 that reduce weight and provide means for gripping and removing tent stakes from the ground. Head 102 includes a first impact surface 108*a* at one end and a second impact surface 108*b* on the opposite end. Rather than being a solid cylinder, the head 102 includes a first rib 110*a* and second rib 110*b* perpendicular to first rib 110*a* for strength, rigidity and weight reduction compared to a solid head. Molded plastic mallets can weigh less than a pound and can be carried by backpackers.

Hammers, sledge hammers, axes, and picks having steel heads provide high durability and weight. Handles are typically made from wood or metal for durability. They are built for heavy impact but are difficult to carry long distances and are unsuitable for backpacking because of their weight (e.g., 3-50 pounds). Lightweight ice pickaxes or axes hammers, which including a hatchet at one end and a pick or hammer at the other end, can be made from titanium and can weigh less than one pound.

Mallets, hammers, axes, hatchets, picks, and other striking tools provide a stark tradeoff between weight and functionality. The advantage of heavy striking tools is that they are highly effective in performing their intended purpose (e.g., driving in stakes, nails, spikes, wooden posts, and signs, smashing objects, breaking rocks, penetrating through dirt, rock or ice, or chopping through wood). In contrast, the main advantage of lightweight mallets, pickaxes, axe hammers, or other striking tools, is that they are lightweight and easy to carry, particularly when reduced weight is important, such as when backpacking or climbing. However, lightweight striking tools are less effective, and can be ineffective, for their intended use (e.g., in driving in stakes, nails, spikes, wooden posts, and signs, smashing objects, breaking rocks, penetrating through dirt, rock or ice, or chopping through wood). Thus, the choice is between a striking tool that is effective but heavy and difficult to carry for long distances, such as while backpacking or climbing, or a striking tool that is lightweight and easy to carry but is less effective, or even ineffective, in performing its intended function.

SUMMARY

Disclosed herein are adjustable weight striking devices, such as mallets, hammers, sledge hammers, picks, hatchets, axes, or other striking tools, that can be relatively lightweight when unloaded and which have increased weight when temporarily loaded with weighting material. The adjustable weight striking devices can have substantially lower weight for ease of carrying and then temporarily loaded with weighting material to increase weight and impact forces during use. The weighting material can temporarily increase the weight of the striking device by 50%, 100%, 150%, 200%, 250%, 300%, 400%, 500% or more depending on the size and density of the device and the size and density of the weighting material.

According to several embodiments, adjustable weight striking device include a body, a handle extending from the body, a platform for temporarily receiving weighting material, means for securing weighting material to the platform, a working end on or attached to the body, and a striking tool at the working end. The striking tool can be fixedly or removably attached to the working end.

In one embodiment, the body is hollow and includes an interior chamber and at least one surface within the interior chamber that provides in internal platform for temporarily receiving weighting material. The hollow body also includes an access opening for inserting weighting material into and removing weighting material from the interior chamber. The means for securing weighting material to the internal platform can include one or more walls that define the interior chamber and a cover that can selectively cover and uncover the access opening. When uncovered, the access opening permits weighting material to be inserted into or removed from the interior chamber. Covering the access opening with the cover retains the weighting material within the interior chamber and on the internal platform during use.

According to another embodiment, the body includes an external platform for temporarily receiving weighting material. The means for securing weighting material to the external platform can include one or more straps or other fasteners that can be selectively attached to and detached from the platform and/or each other in order to selectively secure weighting material to and release weighting material from the external platform. Example fasteners can be one or more straps, such as lightweight fabric straps with clasps, slide locks and/or Velcro (hook and loop system), that can be temporarily wrapped around and/or placed over the weighting object. The strap(s) can be permanently fastened at one end to the platform with a free end that can be temporarily locked with adjustable length around the weighting material(s). Another example of a strap is a bungee cord or rubber strap with a hook, clasp, or other known attachment means at one or both ends. Multiple weighting objects can be stacked and/or placed side-by-side and held in place on the external platform by one or more fasteners (e.g., straps).

According to an embodiment variation, the body with external platform may optionally be hollow to further reduce weight and/or provide an interior chamber that can receive additional weighting material therein. In such case, the adjustable weight striking device will include both internal and external platforms for temporality holding weighting material. Access to the interior chamber can be provided by an access opening through the hollow body. A cover can selectively cover and uncover the access opening. In one embodiment, the access opening passes through the external platform such that the weighting material or object attached to the external platform can act as a "cover" to temporarily hold weighting material within the interior chamber.

The weighting material can be any desired material that can temporarily increase the weight and striking force of the adjustable weight striking device. In the case of a body that includes an interior chamber and an interior platform, the weighting material may comprise any material that can fit within the interior chamber. Examples include sand, water, dirt, pebbles, gravel, lead fishing sinkers, pocket knife, coins, and combinations thereof. In the case of a body that includes an exterior platform, the weighting material may comprise any material that can be placed onto and secured to the exterior platform. Examples include solid weighting objects such as a rock, brick, metal slab, or stone slab. Multiple solid weighting objects can be stacked and/or placed side-by-side on the platform.

The body may comprise a low density material, such as polymer, low density metal alloy and/or low density ceramic. According to one embodiment, the working end and/or striking tool is sufficiently strong in order to withstand applied forces associated with striking an object with sufficient striking force to carry our a desired striking function. Because the weighting material moves together with the platform during movement of the striking device, when the striking tool impacts an object, the weighting material bears down on the platform, transferring its momentum through the working end and to the striking tool.

When it is desired to minimize the weight of the adjustable weight striking device, such as while backpacking, hiking, climbing, or swimming, the platform can be devoid of weighting material. When it is desired to increase or maximize the weight of the adjustable weight striking device during use, weighting material can be temporarily placed on and secured to the platform. Suitable weighting materials can be found virtually anywhere on earth and virtually anywhere a backpacker, hiker, or climber might be. Weighting material can temporarily increase the weight of the striking device by 50%, 100%, 150%, 200%, 300%, 400%, 500% or more depending on the weight of the weighting material as compared to the weight of the unloaded device. Increasing the weight of the striking device substantially increases impacts forces during use. Because momentum equals mass times velocity (p=mv), temporarily increasing the weight of the striking device increases its momentum at a given swinging velocity, which increases striking forces.

The body connecting the platform to the working end can include one or more tubes or shafts that provide a desired spacing therebetween. The body may also accommodate fixed or temporary attachment of a laterally extending (e.g., perpendicular) handle. Any desired striking tool can be fixedly or removably attached to the working end. Non-limiting examples include a flat, curved, spiked, or multi-faceted tool, such as a hammer, mallet, chopping blade (e.g., ax or hatchet), pick (e.g., single pointed, blunt or toothed), hammer with multiple spikes or tips, or other flat, curved, or multi-surface tool.

According to one embodiment, the striking tool can be removably attached to the working end means by any suitable locking means. Examples include one or more of a slot, channel or recess in the working end and one or more of a flange, rail or ridge in the striking tool that correspond to and mates with the at least one slot, channel or recess in the working end. Other examples include one or more of a flange, rail or ridge in the working end and one or more of a slot, channel or recess in the striking tool that correspond to and mates with the at least one flange, rail or ridge in the working end. Other auxiliary attachment devices known in the art can assist in temporarily locking the striking tool to the working end. According to one embodiment, the contact surface between the striking tool and working end can be maximized in order to maximize distribution of forces The density of some, most or all of the material(s) used to make the adjustable weight striking device can be less than about 4.9 g/cm$^3$, 4.7 g/cm$^3$, 4.5 g/cm$^3$, 4.25 g/cm$^3$, 4 g/cm$^3$, 3.5 g/cm$^3$, 3 g/cm$^3$, 2.75 g/cm$^3$, 2.5 g/cm$^3$, 2 g/cm$^3$, 1.75 g/cm$^3$, 1.5, 1.3 g/cm$^3$, 1.2 g/cm$^3$, or 1.1 g/cm$^3$, although a minor portion can be steel or other strong metal with higher density when required to provide a desired working strength. In some cases, the striking tool may comprise high strength, lightweight titanium alloy to maximize strength and minimize weight. According to one embodiment, at least about 75%, 80%, 85%, 90%, or 95% of the device (by weight or volume) can be lower density material, while less than about 25%, 20%, 15%, 10%, or 5% of the device (by weight or volume) can be higher density material. For example, part of the device can be a polymer having a first lower density and another part of the device can be a low density metal, such as titanium alloy or aluminum. A minor portion may comprise stainless steel, which has a density of about 8 g/cm$^3$, to provide high impact strength and resistance to breaking, denting, or dulling.

These and other advantages and features of the invention will become more fully apparent from the following description and appended claims, or may be learned by the practice of the invention as set forth hereinafter.

DETAILED DESCRIPTION OF THE PREFERRED EMBODIMENTS

Disclosed herein are adjustable weight striking devices having reduced weight when devoid of weighting material and increased weight when loaded with weighting material. This permits a user to minimize the weight of the device when desired (e.g., when carrying the device) and selectively increase or maximize weight when desired (e.g., when using the device to strike an object or material).

It should be understood that the structures and features shown in the Figures are merely exemplary and for illustrative purposes and are not to be understood as limiting the scope of the invention. Once one of ordinary skill in the art has read and understood the disclosure, it will be readily apparent how various structural features can be arranged or configured in order to provide the same or similar functionality. All such variations are within the scope of the disclosure and considered to be part of the disclosed invention. By way of example, any feature from one embodiment may be incorporated as a feature in any other embodiment to provide additional functionality.

Figure 2A:
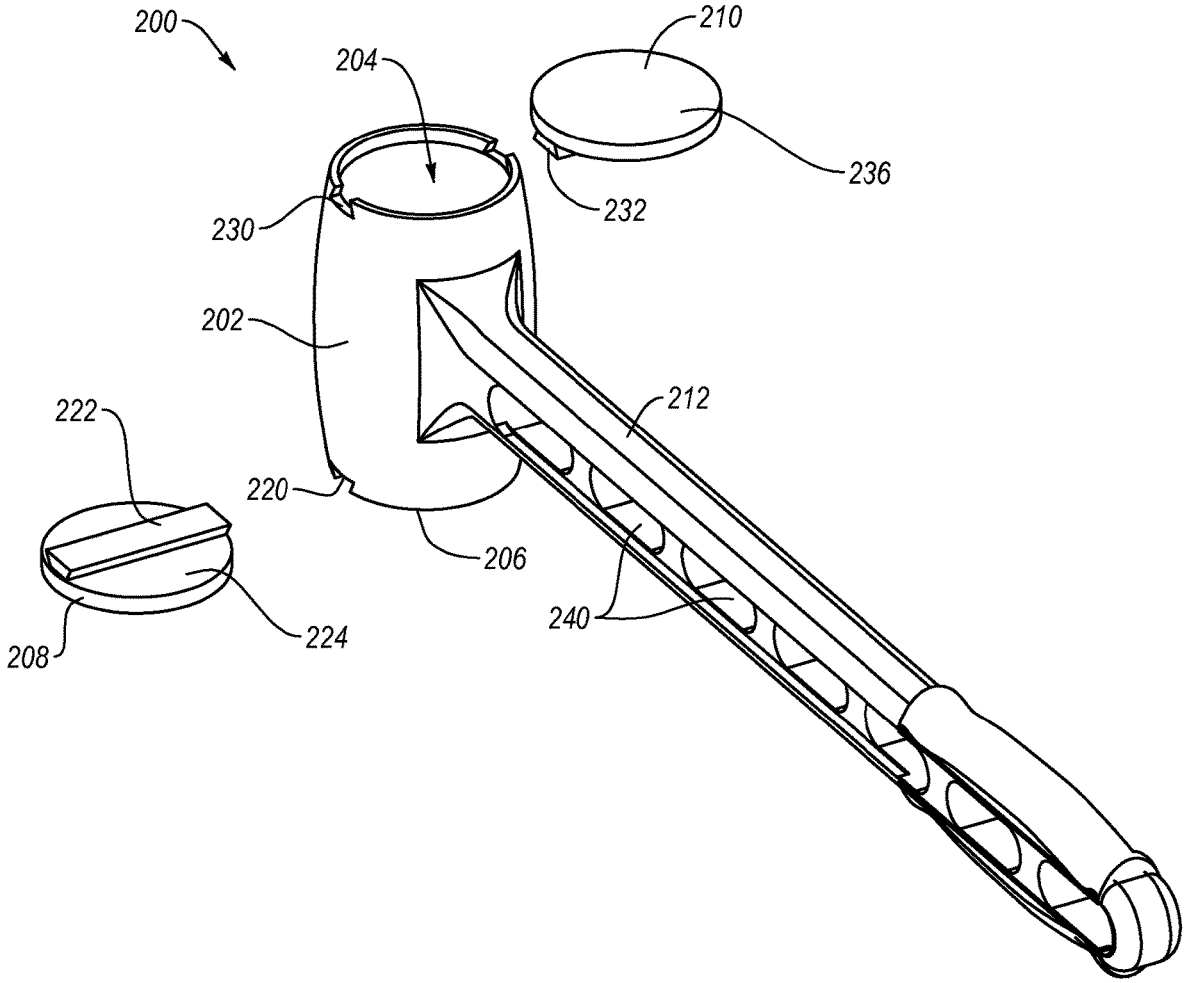
FIGS. 2A-2C illustrate an example embodiment of an adjustable weight striking device having a hollow body, a striking tool removably attached to the hollow body, a removable cover for selectively covering and uncovering the access opening, and a handle extending from the hollow body.
Figure 2B:
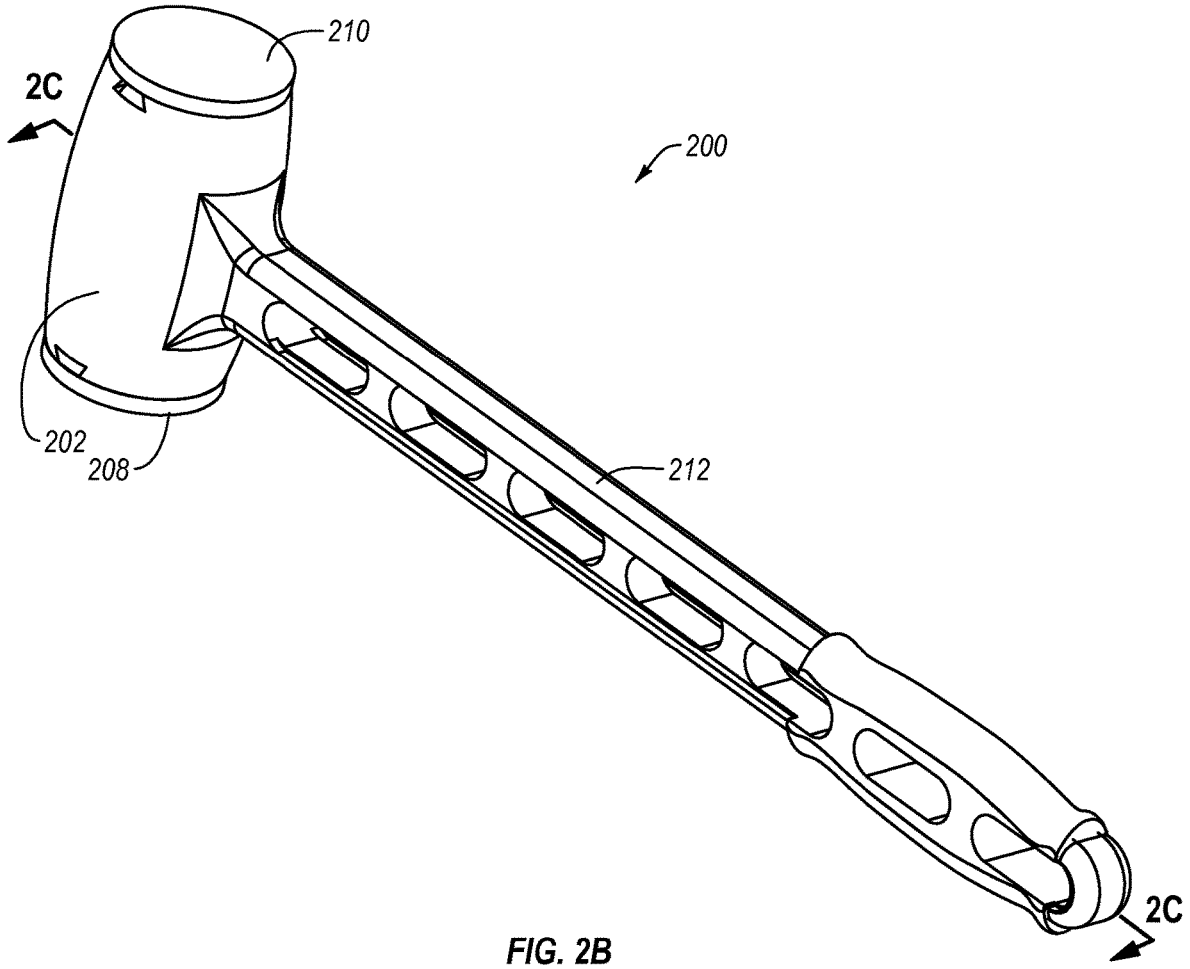
Figure 2C:
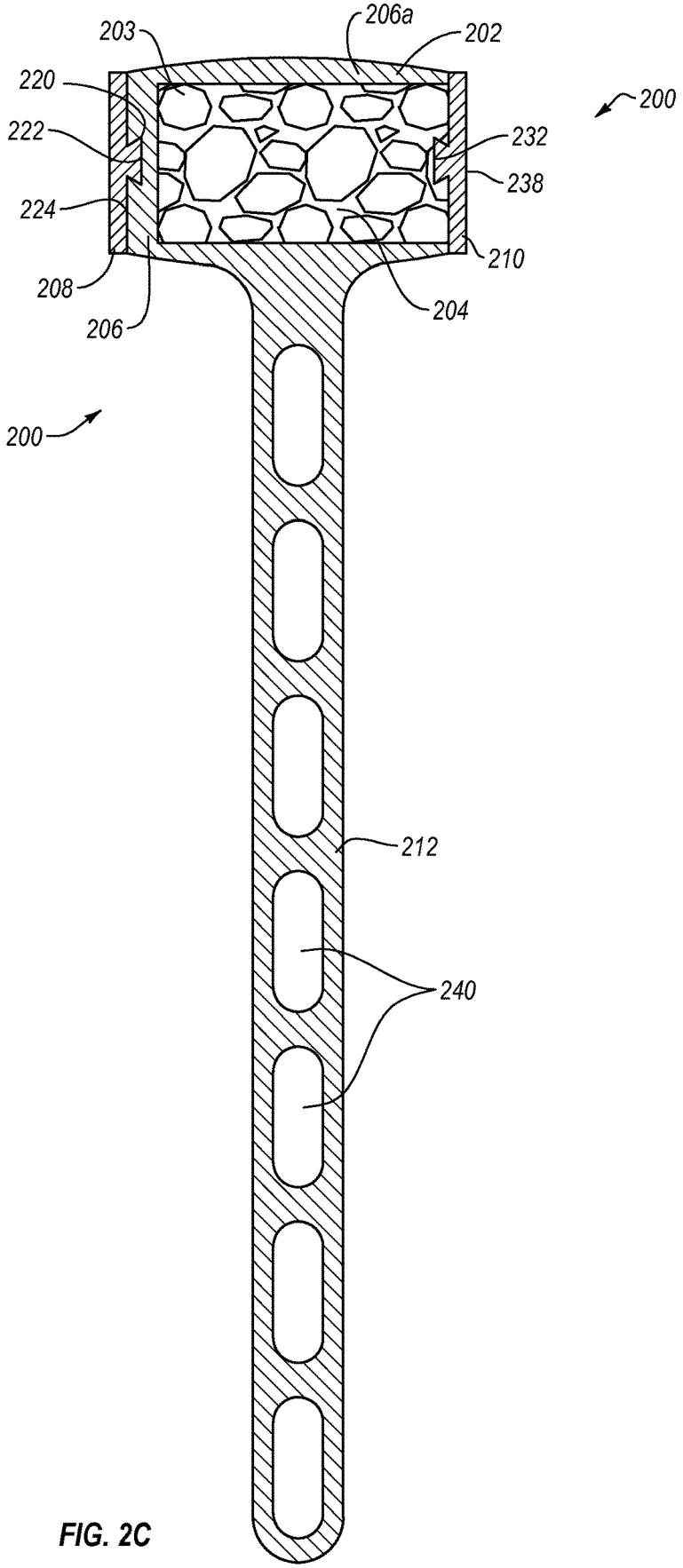

FIGS. 2A-2C illustrate an example adjustable weight striking device 200. FIG. 2A is an exploded view, FIG. 2B is an assembled view, and FIG. 2C is a cross-sectional view of striking device 200 (with example weighting material inside, such as rocks or pebbles). Striking device 200 includes a hollow body 202, an interior chamber 204, a working end 206, a striking tool 208, a removable cover 210, and an elongate handle 212 extending laterally from hollow body 202. Elongate handle 212 is shown fixedly attached to body 202 but can be releasably attached according to other embodiments. Elongate handle 212 includes spaced apart passageways 240, which can serve the dual purpose of weight reduction and as an auxiliary tool (e.g., to pull tent stakes out of the ground, hanging device 200 from a hook and/or providing means for tying device 200 to a backpack or other structure using a cord).

Disposed at working end 206 of body 202 is a striking tool 208, which can be integral with working end 206 or, as shown in FIGS. 2A-2C, releasably attachable to working end 206. Any known coupling means can be used to selectively couple and decouple striking tool 208 to and from working end 206. In this embodiment, working end 206 includes a channel 220 having angled walls that receive a rail 222 having correspondingly angled walls of striking tool 208. Selectively mating and decoupling of channel 220 and rail 222 permits striking tool 208 to be selective attached to and detached from working end 206 of body 202. Striking tool 208 includes a force bearing surface 224 that makes abutment with a corresponding surface on working end 206. This permits striking forces to be transferred across most or all of the surface area of working end 206. Properly distributing striking forces can provide high strength and durability while using low weight materials. Striking tool 208 can be locked in place on working end 206 using any known locking devices, such as one or more rotating clips (not shown), friction fit, snap fit, abutment with a sidewall, and combinations thereof.

Figure 6:
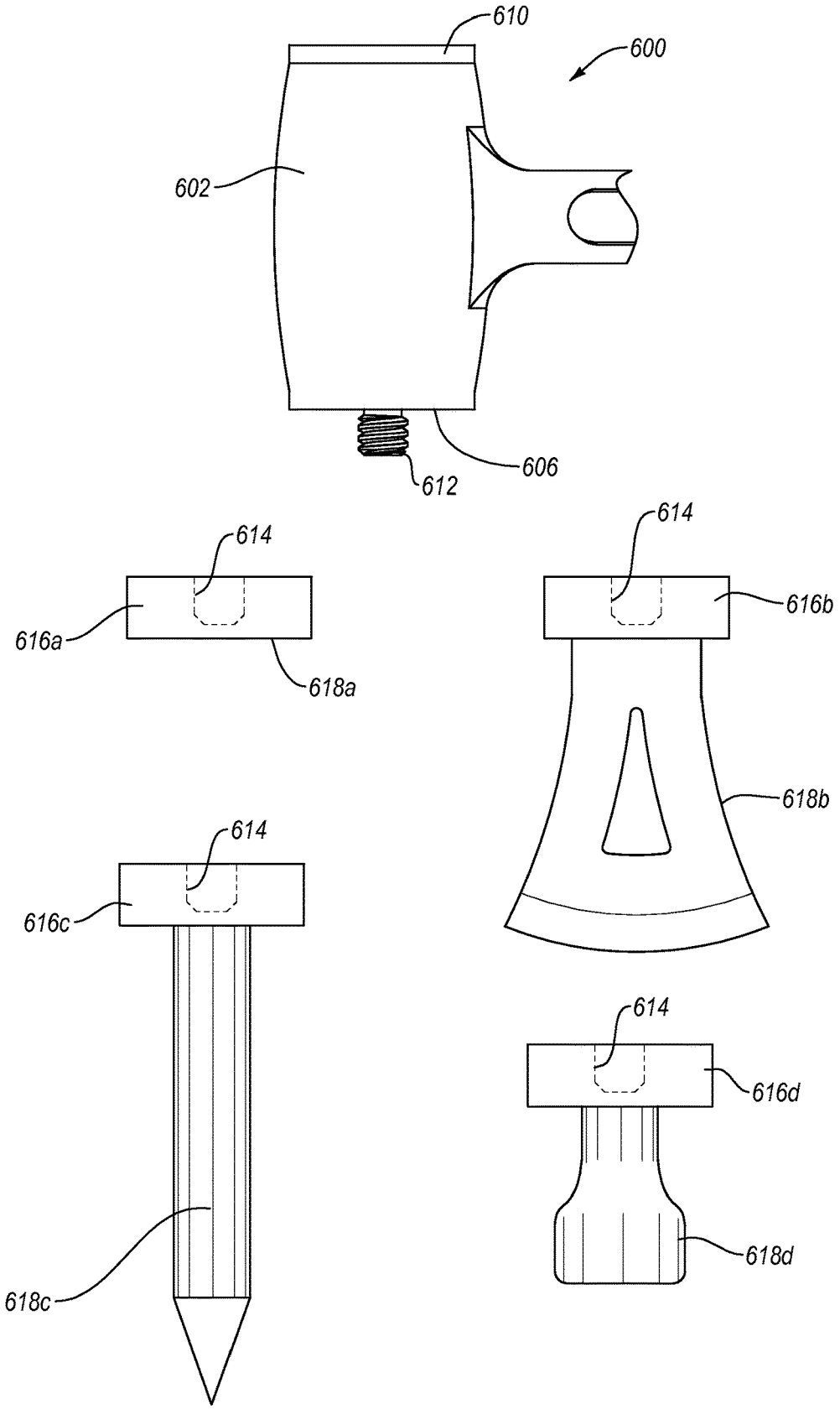
FIG. 6 illustrates examples of different striking tools that can be selectively attached to and removed from the body of an adjustable weight striking device.
Figure 6:
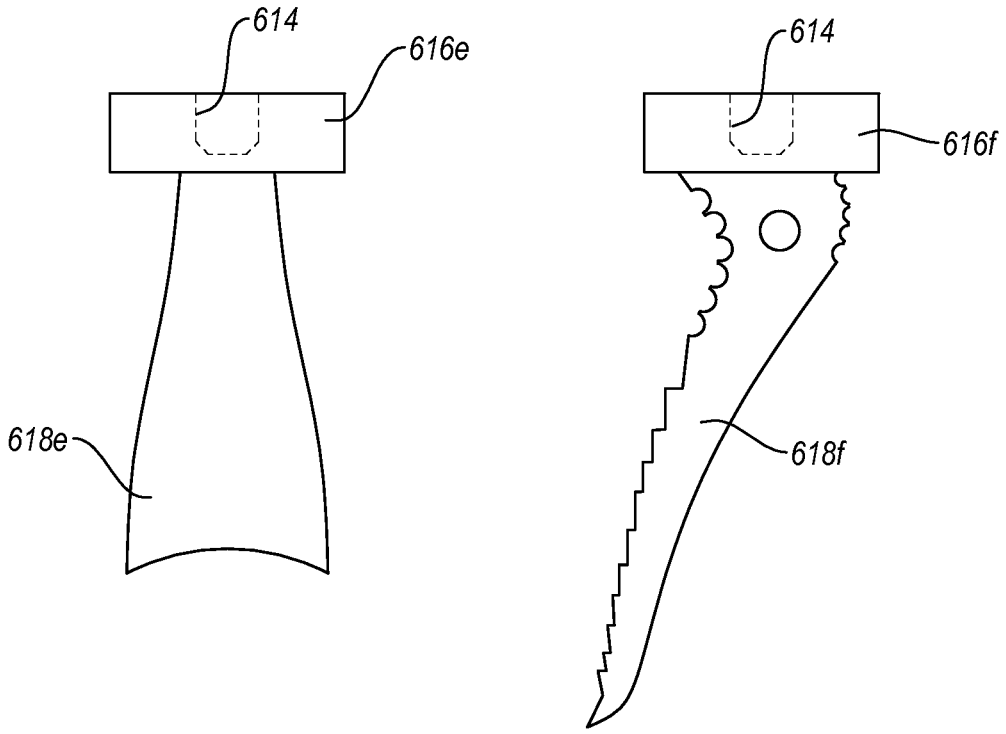

Another example of coupling means for selectively coupling and decoupling striking tool 208 to and from working end 206 is illustrated in FIG. 6, in which various striking tools 616 can be selectively attached to working end 606 of body 202 by a threaded rod (or flange) 612 and corresponding threaded hole (or recess) 614.

Removable cover 210 can be selectively attached to and detached from body 202 in order to selectively cover and uncover an opening in body 202 (e.g., on an end opposite working end 206, although it could be through a side of body 202, or even through working end 206 itself, in which case a portion of detachable striking tool 208 can function as a selectively removable cover). Removing cover 210 provides access to interior chamber 204 and permits a user to selectively add weighting material to or remove weighting material from interior chamber 204.

As illustrated in FIGS. 2A-2C, cover 210 can be removably attached to body 202 by means selective mating of rail 232 of cover 210 with channel 230 formed in body 202. Cover 210 can be locked in place over the opening in body 202 using any known locking devices, such as one or more rotating clips (not shown), friction fit, snap fit, abutment with a sidewall, and combinations thereof.

FIGS. 2B and 2C illustrates striking device 200 in assembled form. FIG. 2C shows a cross section of interior chamber 204 which, when empty, minimizes weight of the device. Filling interior chamber 204 with weight material (as illustrated in FIG. 2B) increases the weight of the device, particularly body 202 where increased weight is advantageous for bearing against striking tool 208 during use. In this embodiment, striking tool 208 has a flat outer surface, making striking device 200 useful as a mallet, hammer or similar striking tool. Alternatively, striking tool 208 can be (or be replaced with) any known striking tool. Examples of other striking tools are illustrated in FIGS. 3 and 6.

Figure 3:
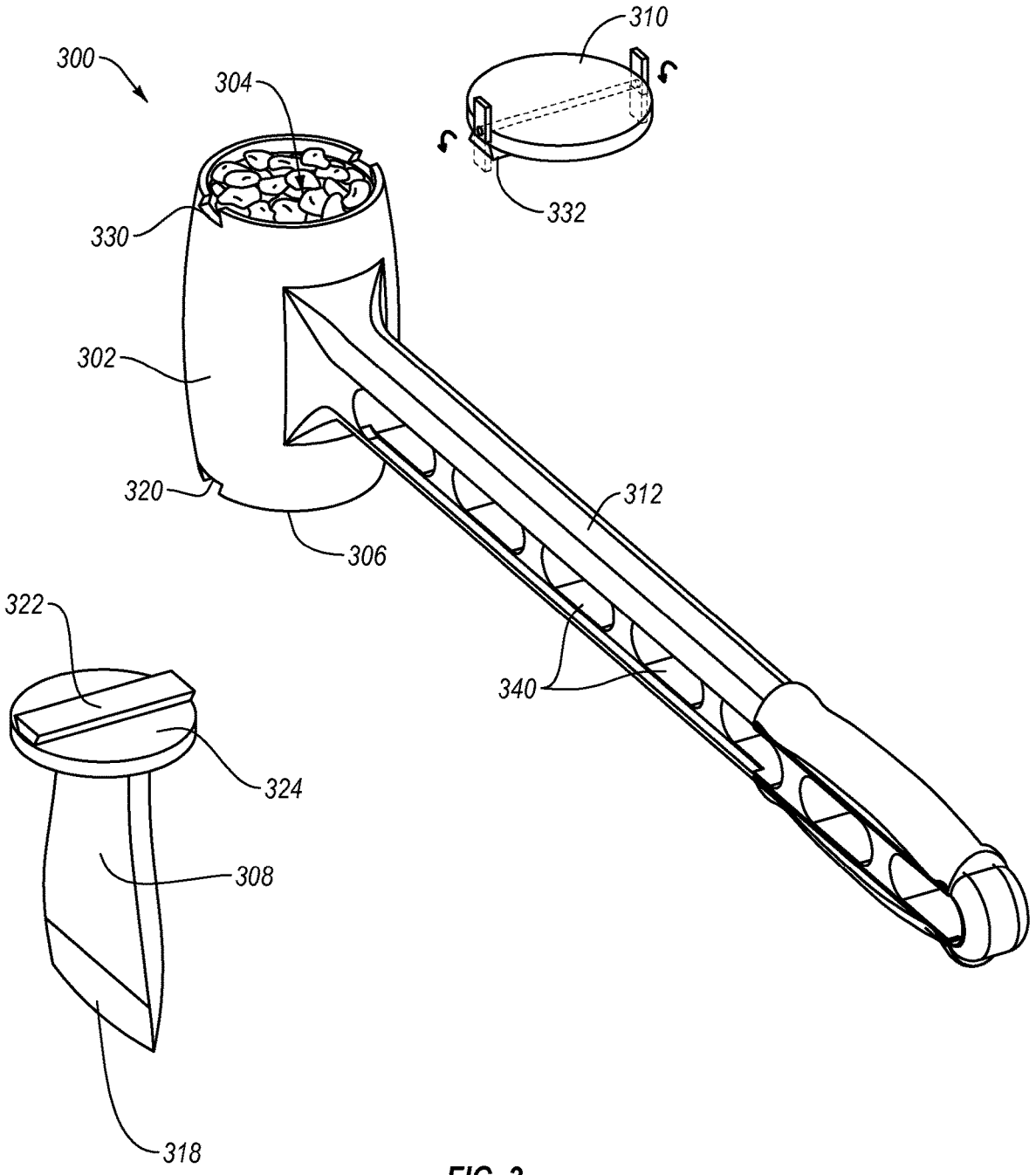
FIG. 3 is an exploded view of an example embodiment of an adjustable weight striking device similar to the embodiment of FIGS. 2A-2C showing how a different striking tool can be selectively attached to and detached from the working end.

FIG. 3 illustrates a striking tool 300 that includes a hollow body 302, an interior chamber 304, a working end 306, a striking tool 308, a removable cover 310, and an elongate handle 312 extending laterally from hollow body 302. Elongate handle 312 is shown fixedly attached to body 302 but can be releasably attached according to other embodiments (e.g., by having threads that permit it to be screwed into and unscrewed from corresponding threads in body 302) (not shown). Elongate handle 212 includes spaced apart passageways 340, which can provide weight reduction and/or be used as a tool.

At working end 306 of body 302 is a striking tool 308, which is releasably attachable to working end 306. Any known coupling means can be used to selectively couple and decouple striking tool 308 to and from working end 306. In this embodiment, working end 306 includes a channel 320 having angled walls that receive a rail 322 having correspondingly angled walls of striking tool 308. Selectively mating and decoupling of channel 320 and rail 322 permits striking tool 308 to be selective attached to and detached from working end 306 of body 302. Striking tool 308 includes a force bearing surface 324 that makes abutment with a corresponding surface on working end 306. This permits striking forces to be transferred across most or all of the surface area of working end 306. Striking tool 308 can be locked in place on working end 206 using any known locking devices, such as one or more rotating clips (not shown), friction fit, snap fit, abutment with a sidewall, and combinations thereof.

FIG. 3, when viewed with FIGS. 2A-2C, illustrates how a first striking tool 208 having a first functionality can be replaced with a second striking tool 308 having a different functionality. As illustrated, striking tool 308 includes a sharpened end 318, which can be used for cutting or chopping (e.g., sharpened end 318 can function as an ax, hatchet or other similar cutting or chopping tool). Alternatively, striking tool 308 can include alternative ends that provide other functionality, such as ends 618 illustrated in FIG. 6.

Figure 4A:
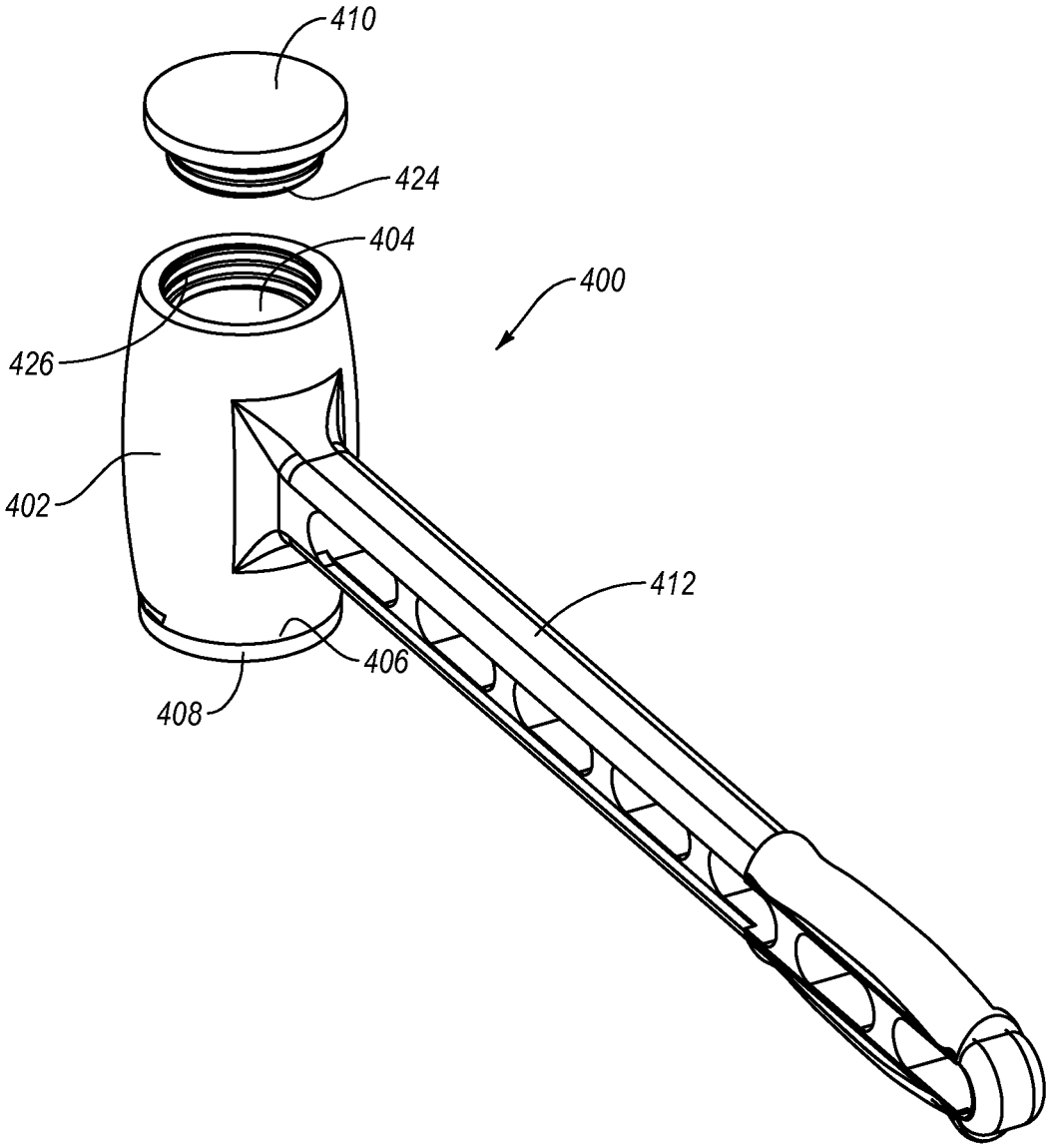
FIGS. 4A and 4B illustrate examples of adjustable weight striking devices having a cover that can be selectively screwed onto and unscrewed from the hollow body.
Figure 4B:
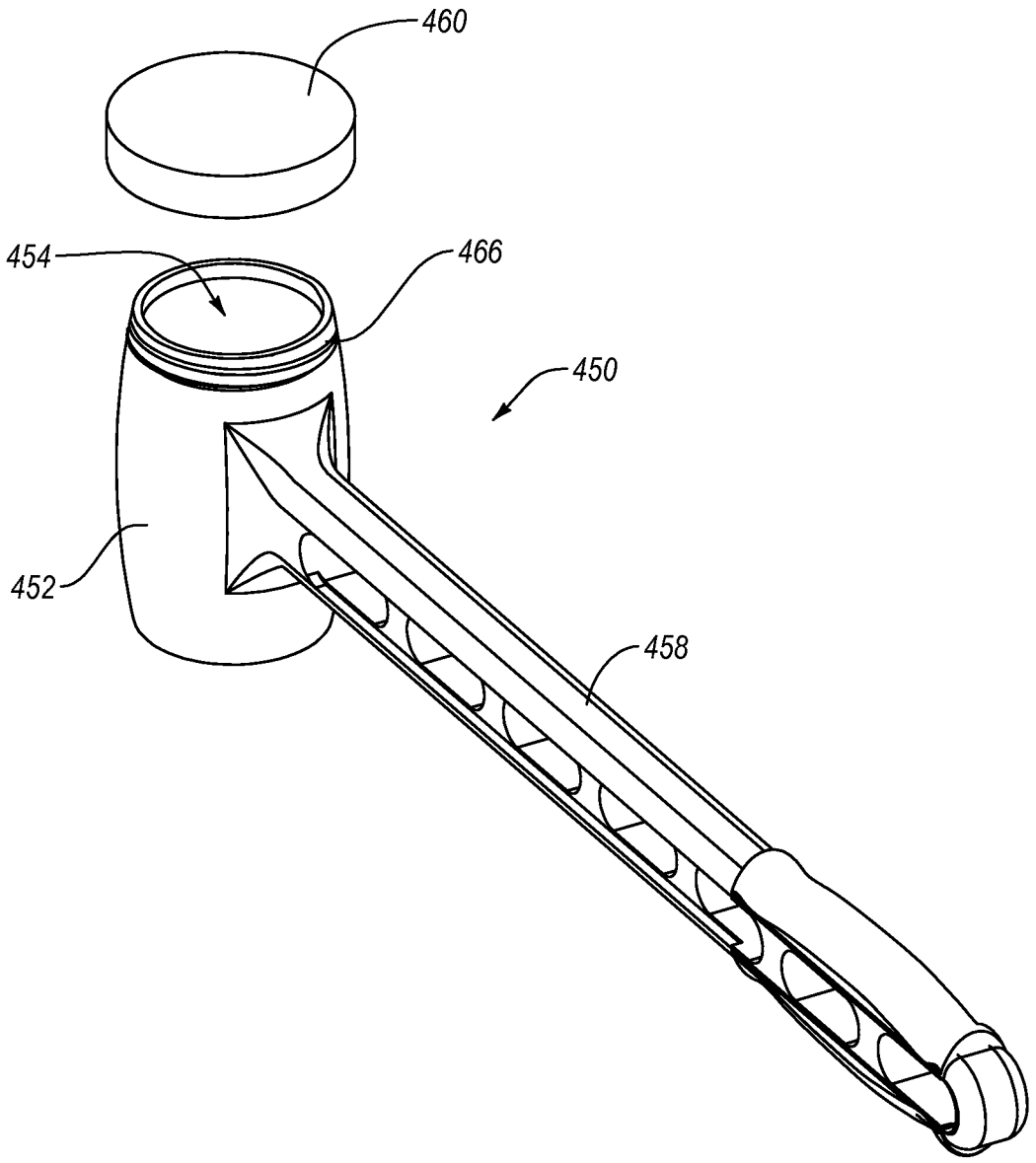

FIGS. 4A and 4B illustrate adjustable weight striking devices 400, 450 having alternatively means for selectively opening and closing an interior chamber that can be temporarily filled with weighting material. FIG. 4A illustrates an example striking device 400 that includes a hollow body 402, an interior chamber 404, a working end 406, a striking tool 408 fixedly or releasably attached to working end 406, a removable cover 410, and a handle 412. Cover 410 includes male threads 424 that fit within and threadably mate with corresponding female threads 426 formed on (or in) body 402.

FIG. 4B illustrates an example striking device 450 that includes a hollow body 452, an interior chamber 454, a removable cover 460, and a handle 458. Body 452 includes male threads 566 on an exterior surface that that fit within and threadably mate with mate with corresponding female threads (not shown) formed on or in cover 460.

An advantage of cover 410 of device 400 illustrated in FIG. 4A is that cover 410 can have the same diameter as an adjacent portion of body 402 to form an uninterrupted body/cover 402, 410 construct if desired. A disadvantage is that sand or grit can sometimes collect in female threads 426. Thus, an advantage of cover 460 of device 450 illustrated in FIG. 4B is that male threads 466 on the exterior surface of body 452 are less likely to collect sand or grit. Moreover, interior chamber 454 can be filled to full capacity before attaching cover 460. A disadvantage may be that cover 460 may have diameter or lip that extends beyond a diameter of an adjacent portion of body 452. This can be remedied by recessing male threads 466 inwardly relative to an outer surface of body 452 sufficient to accommodate a wall thickness of the overhanding portion of cover 460 that includes the female threads (not shown).

Another advantage of covers that can be screw onto or unscrewed from the body is that they can seal the interior chamber when at least a portion of weighting material placed into the interior chamber is a liquid, such as water, or a readily flowing material such as sand, dirt or mud. Covers 410, 460 can provide a reliable seal and prevent materials from flowing out of the interior chamber during use (e.g., using a plastic, metal or elastomer gasket). Of course, any removable cover can be configured to provide a desired sealing mechanism (such as by using flexible materials that are pressed together when mated).

FIGS. 5A-5D illustrate an alternative embodiment of an adjustable weight striking device 500 that permits a weighting member 520 (e.g., rock, brick, or slab) (FIGS. 5C-5D) to be externally attached to the device. This permits the use of substantially larger weighting materials as compared to embodiments that include an interior chamber and a cover, which typically hold only as much weighting material as can fit inside the interior chamber. Striking devices such as striking device 500 can theoretically hold any sized weighting material(s) so long as the resulting construct can be feasibly used as desired.

Figure 5A:
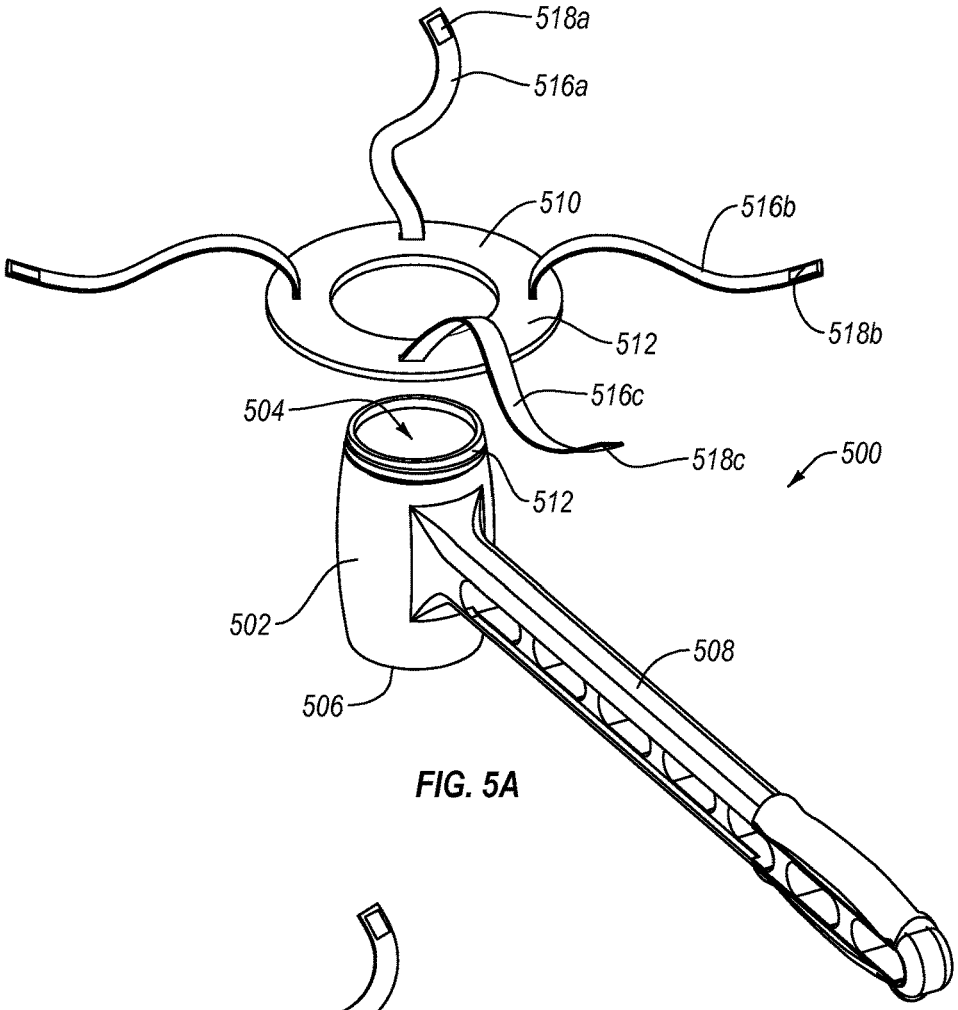
FIGS. 5A-5D illustrate an example embodiment of an adjustable weight striking device having a body, a working end, an external platform for selective placement of weighting material thereon, and one or more straps for temporarily securing weighting material on the platform.
Figure 5B:
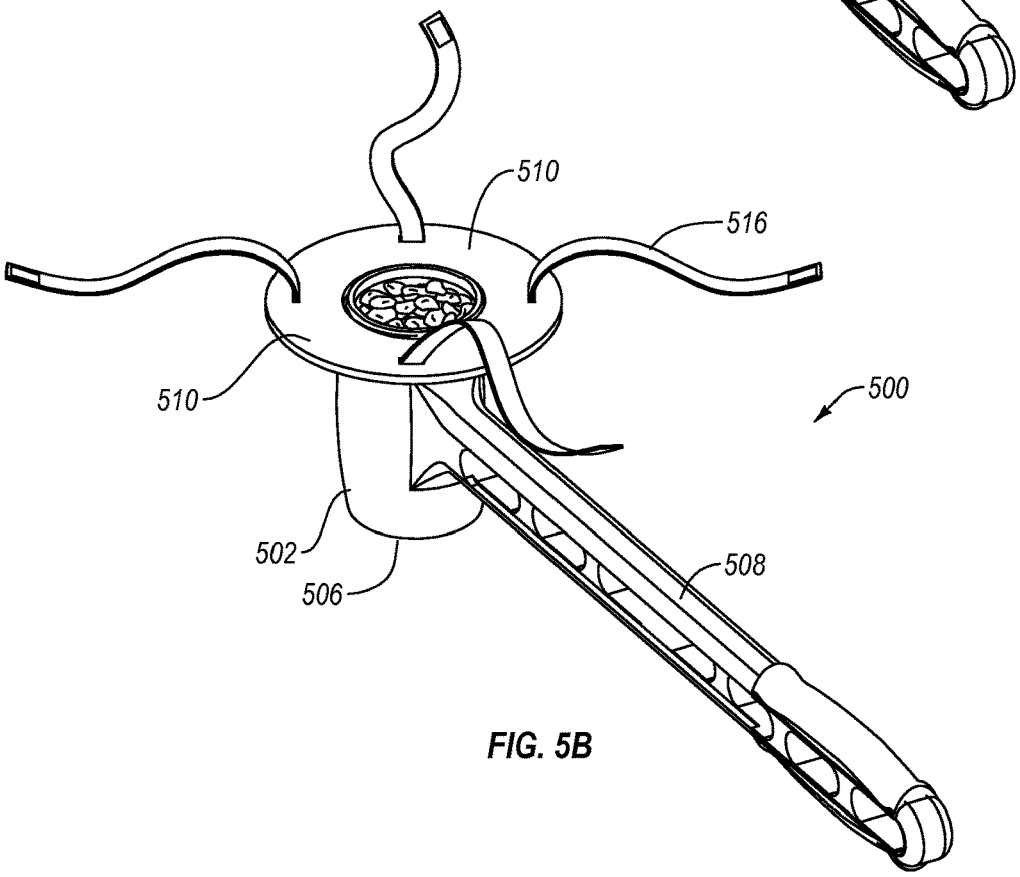
Figure 5C:
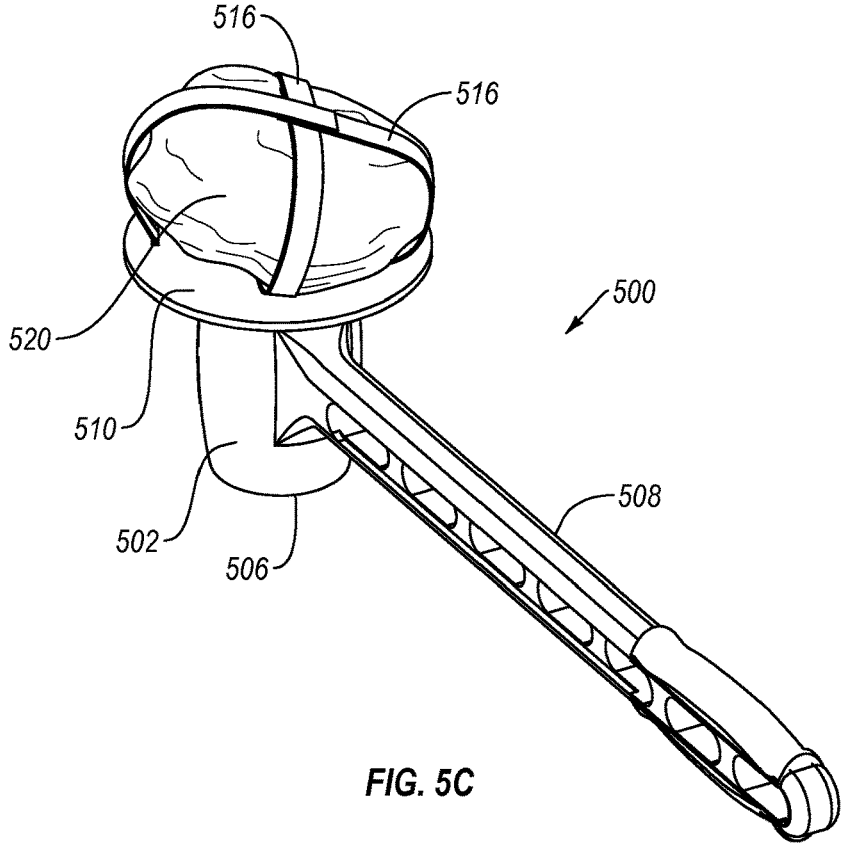
Figure 5D:
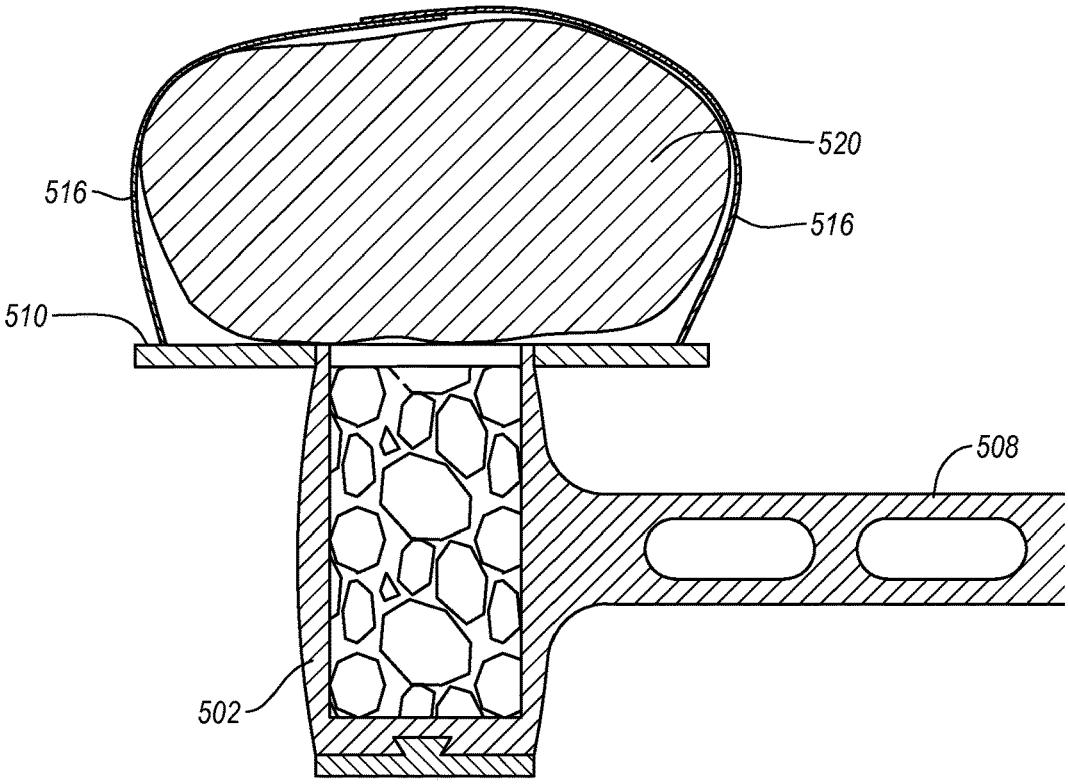

As illustrated in FIGS. 5A-5D, adjustable weight striking device 500 includes a body 502, a working end 506, and an external platform 510 with an outer surface or rim 512 for supporting thereon a weighting object 520. In the embodiment shown, body 502 is hollow and includes an interior chamber 504, which reduces overall weight of striking device 500 and also permits a user to optionally fill interior chamber 504 with additional weighting material (FIGS. 5B, 5D).

Interior chamber 504 is similar to previous embodiments in that external platform 510 is illustrated as being a removable cover that can be selectively coupled to and decoupled from body 502 by means of threads 512 that mate with corresponding threads of platform or cover 510. Providing a cover 510 that is continuous without a central opening (not shown) permits a user to selectively cover and uncover interior chamber 504. Providing this type of covering mechanism can be advantageous when at least a portion of weighting material placed into interior chamber 504 is a liquid, such as water, or a readily flowing material such as sand, dirt or mud. Cover 510 can seal interior chamber 504 and prevent materials from flowing out during use.

It should be understood however, that platform 510 can be fixedly attached to body 502, such by being integrally joined to or molded therewith. In such case, body 502 may or may not include an interior chamber in view of the fact that external weighting material can be placed on platform 510, which eliminates the need for internal weighting material. Body 502 can have any desired cross sectional shape that provides sufficient strength and rigidity while transferring forces from platform 510 to working end 506 (e.g., a cylinder or cross).

In the case where body 502 is hollow and includes interior chamber 504, platform 510 can have a central hole (FIGS. 5A and 5B) bounded by outer rim 512 that provides access to interior chamber 504. The central hole can permit a user to place weighting material (not shown) within interior chamber 504, such as rocks, sand or other solid objects. Thereafter, placement of a solid weighting object 520 over the central hole and supporting it using outer rim 512 can effectively "cover" or "seal" interior chamber 504 and retain therein solid weighting materials. Weighting object 520 may, however, not provide a liquid tight seal such that water or other flowable weighting materials may not be feasible (although water will typically be unnecessary when using rocks or sand in interior chamber 504 and placing one or more rocks or slab 520 onto rim 512 of platform 510).

FIGS. 5A-5D further illustrate means for securing weighting material 520 (e.g., one or more solid objects, such as rock(s), brick(s) or slab(s)) to external platform 510. Illustrated are four straps 516*a*, 516*b*, 516*c*, 516*d* that can be selectively locked and unlocked from each other to temporarily, yet securely, retain weighting material 520 on platform 510. Straps 516*a*, 516*b*, 516*c*, 516*d* can comprise a lightweight fabric, such as nylon or polyester, and include fastening members 518*a*, 518*b*, 518*c*, 518*d*, which can be any fastening means known in the art (e.g., clasps, slide locks and/or Velcro® (hook and loop system)), that can be used temporarily interconnect straps 516*a*, 516*b*, 516*c*, 516*d*. In use, straps 516*a*, 516*b*, 516*c*, 516*d* can be wrapped around and/or placed over the weighting object. Straps 516*a*, 516*b*, 516*c*, 516*d* can be permanently fastened at one end to platform 510 with free ends that can be temporarily locked to a corresponding strap to adjust its length. Alternatively, one or more straps can be permanently attached to platform and then selectively locked to and unlocked from platform (e.g., by being fed through one or corresponding slots in platform 510 (not shown) and then looped and locked back itself using e.g., clasps, slide locks and/or Velcro® (hook and loop system).

Another example of securing means include one or more bungee cords or rubber straps (not shown) with a hook, clasp, or other known attachment means at one or both ends. Multiple weighting objects can be stacked and/or placed side-by-side and held in place on the external platform by one or more fasteners (e.g., straps).

The weighting material can be any desired material that can temporarily increase the weight and striking force of the adjustable weight striking device. In the case of a body that includes an interior chamber and an interior platform, the weighting material may comprise any material that can fit within the interior chamber. Examples include sand, water, dirt, pebbles, gravel, lead fishing sinkers, pocket knife, coins, and combinations thereof. In the case of a body that includes an exterior platform, the weighting material may comprise any material that can be placed onto and secured to the exterior platform. Examples include solid weighting objects such as a rock, brick, metal slab, or stone slab. Multiple solid weighting objects can be stacked and/or placed side-by-side on the platform, thus adding versatility.

When it is desirable for an adjustable weight striking tool to have minimal weight, such as when carrying the tool while backpacking, hiking, climbing or swimming, the interior chamber can be empty and filled with air or lightweight material (e.g., dehydrated food product or fishing flies). When it is desirable for the adjustable weight tool to have increased weight, such as when striking, piercing or cutting an object, the interior chamber can be filled with weighting material. If it is desired to minimize internal movement of weighting material within the interior chamber during use, it may be advantageous to completely fill the interior chamber with weighting material (e.g., by filling any spaces between the body wall and/or solid objects with sand and/or water). If a backpacker, hiker or climber already plans on packing one or more items that can serve as weighting material (e.g., lead sinkers, pocket knife, batteries, compass, food, powder), such item(s) can be carried in the interior chamber of with no increase in total weight of the backpack. The interior chamber can provide storage for any desired item.

FIG. 6 illustrates another embodiment of an adjustable weight striking device 600 having a body 602, a working end 606, an optional cover 610 (if body 602 includes an interior chamber), and tool attachment means at working end. In this case, the tool attachment means is illustrated as a threaded extension (or flange) 612 that can threadably mate with corresponding female threads within hole (or recess) 614 in each of one or more striking tools 616. By way of example, striking tool 616*a* includes a flat striking face 618*a* such striking tool 616*a* can function as a hammer, mallet or other similar hammering or pounding device.

Example striking tool 616*b* alternatively includes a cutting tool 618*b*, which can function as an ax, hatchet, or other chopping tool and can have a flat or convex cutting edge as desired.

Example striking tool 616*c* alternatively includes an elongate or spike-like piercing tool 618*c*, which can function as a pick (e.g., rock, earth or ice pick).

Example striking tool 616*d* alternatively includes a hammer tool 618*d*, which can function as a conventional hammer for striking nails, spikes, stakes or other objects with high impact.

Example striking tool 616*e* alternatively includes a curved cutting tool 618*e* (i.e., which is curved in the cross section rather than, or in addition to, being flat, concavely, or convexly curved at the cutting edge), which can function as an ice ax or similar chopping or gouging function.

Example striking tool 616*f* alternatively includes an elongate serrated cutting or penetrating tool 618*e*, which can function as a gripping end of ice ax or similar piercing and gripping tool.

It will be readily understood that striking tools 616 and others disclosed herein are given solely by way of illustration and not limitation. Any tool known in the art, or which be developed in the future, can be used in connection with the adjustable weight striking devices disclosed herein.

Figure 7:
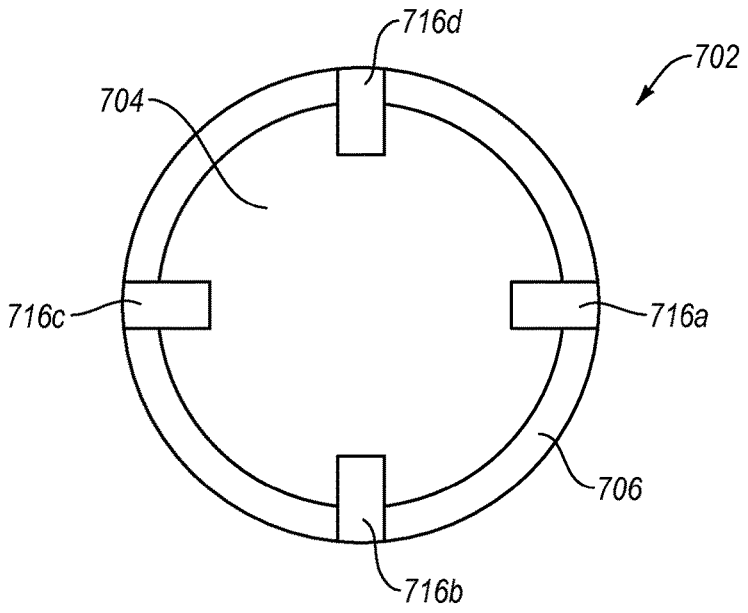
FIG. 7 illustrates a hollow body with ribs for increasing rigidity and strength.

FIG. 7 illustrates an embodiment of a body 702 in cross section for use in an adjustable weight device. Body 702 includes an interior chamber 704 for selective placement and removal of weighting material therein. Interior chamber 704 is defined by an outer wall 706 having a circular cross-sectional shape, although it will be understood that outer wall 706 of this embodiment or any other embodiment disclosed herein can have any desired cross-sectional shape. Non-limiting examples of other possible cross sections include oval, elliptical, triangular, rectangular, pentagonal, hexagonal, and polygonal. An access hole and cover (not shown) can be provided to selectively provide access to or enclose interior chamber 704.

As shown, body 702 further includes a plurality (e.g., 4) of strengthening ribs 716, wherein ribs 716*a*, 716*b*, 716*c*, 716*d* may be integrally formed with outer wall 706 and extend partially into interior chamber 704. Part of one or more of ribs 716 may also protrude beyond the outer surface of outer wall 706 (not shown). It will be appreciated that any number of ribs (e.g., 1-10) can be included to provide desired strength and rigidity of body 702. For example, during hammering, chopping or piercing, ribs 716 can help distribute compressive, flexural, tensile and other stresses across body 702 in order to provide a more rigid working end and prevent deformation and/or damage to body 702. Ribs may extend between and form a rigid bridge between two opposing surfaces of body 702, one or both of which can be working (e.g., hammering) surfaces. Opposing ribs may alternatively join together to form a web that divides an interior chamber into sub chambers (not shown).

Figure 8A:
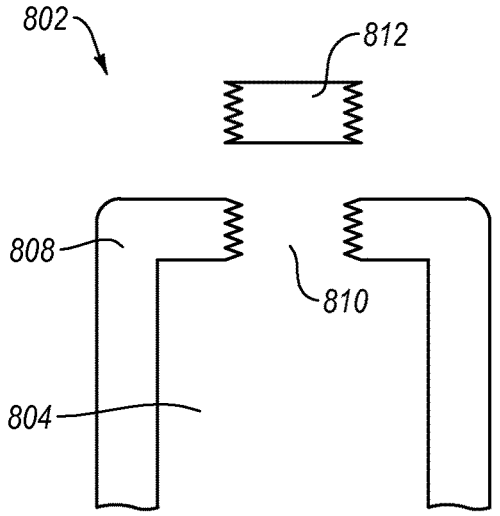
FIGS. 8A and 8B illustrate an example hollow body having and a cover for selectively covering and uncovering an access opening.
Figure 8B:
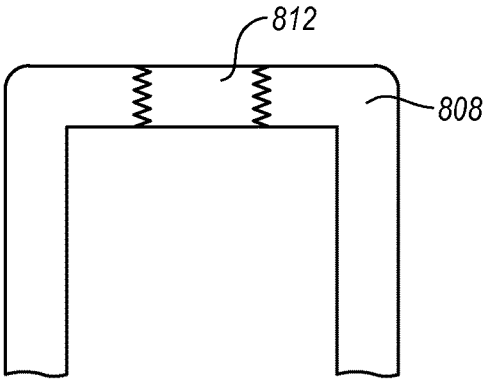

FIGS. 8A and 8B illustrate an embodiment of a hollow body with means for selectively covering and uncovering an access hole in the body. Body 802 includes an outer wall 808 defining an interior chamber 804 and a threaded access opening 810 through outer wall 808. A correspondingly threaded stopper 812 can be selectively removed from threaded opening 810 of outer wall 808, as shown in FIG. 8A, and selectively threaded into threaded opening 810, as shown in FIG. 8B. In this way, threaded stopper 812 can selectively cover and uncover opening 810. Removal of stopper 812 from opening 810 permits weighting material to be selectively inserted into and removed from interior chamber 804. Insertion of stopper 812 into opening 810 encloses weighting material within interior chamber 804 or conveniently keeps stopper 812 together with outer wall 808 when chamber 804 is empty. A flexible leash (not shown) can interconnect stopper 812 and outer wall 808 to prevent accidental loss. Stopper 812 may include a slot, protrusion or other gripping structure (not shown) that can be engaged by a person's fingers, tool or coin when installing and removing stopper 812 from access opening 810.

Figure 9B:
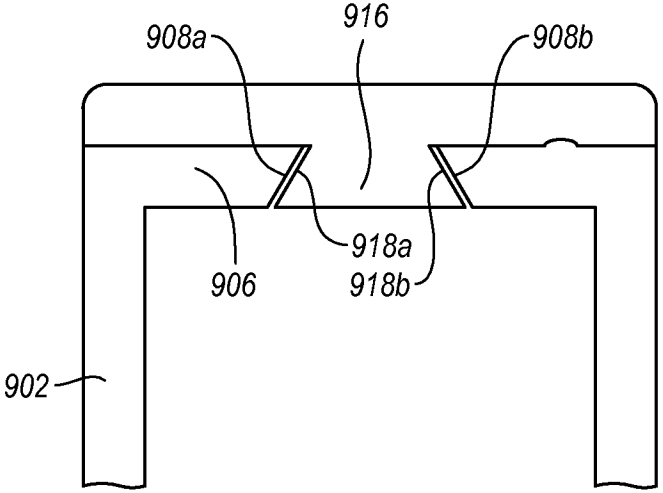
FIGS. 9A-9C illustrate an example hollow body and a cover for selectively covering and uncovering an access opening.
Figure 9A:
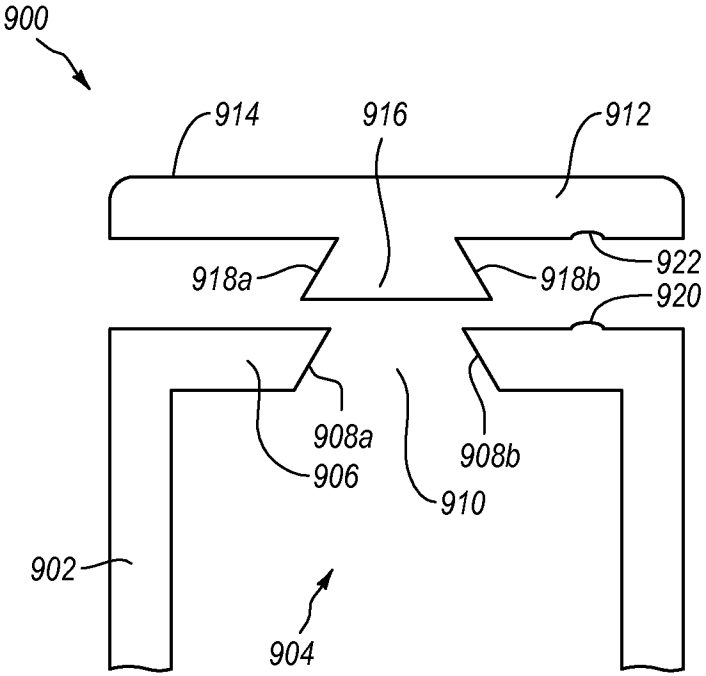
Figure 9C:
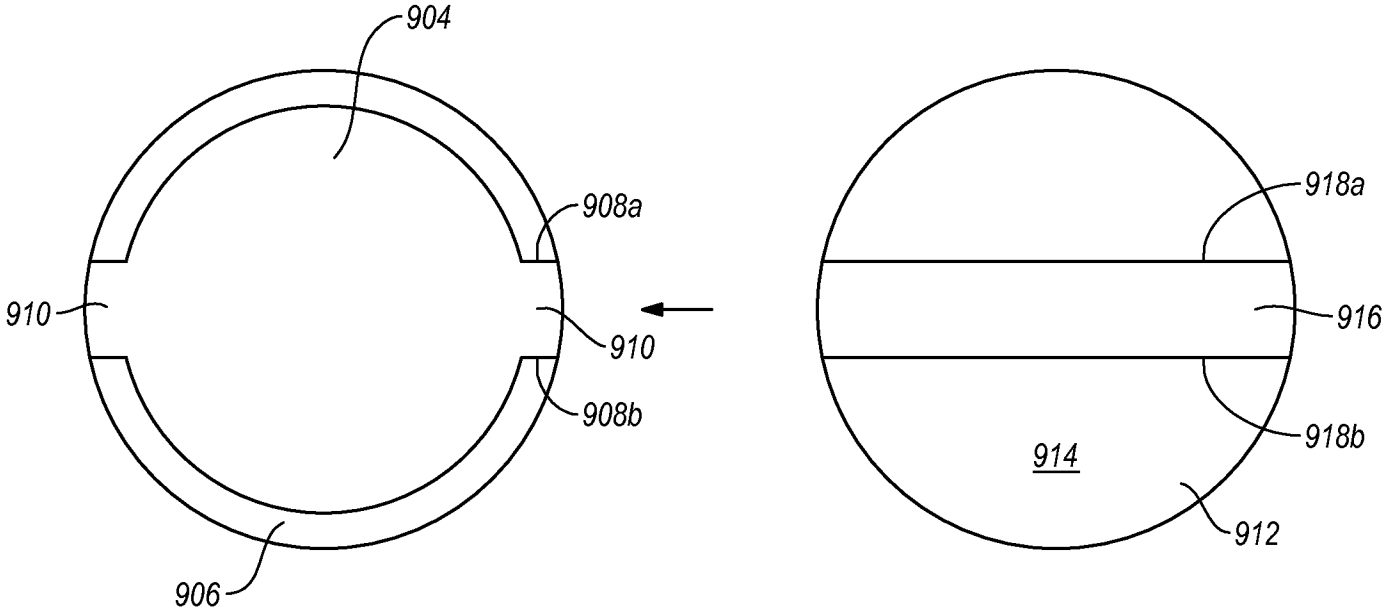

FIGS. 9A-9C illustrate another embodiment of a hollow body with means for selectively covering and uncovering an access hole in the body. Body 900 includes an outer wall 902 partially enclosing an interior chamber 904. An end wall 906 having an opening therethrough is integrally connected to and forms part of outer wall 902 so as to partially enclose interior chamber 904. End wall 906 further includes angled sidewalls 908*a*, 508 that form a channel or recess 910 for slidably receiving a correspondingly sized and shaped rail or protusion. A cover 912 having an outer surface 914 (e.g., hammering surface) includes a rail or protrusion 916 having angled sidewalls 918*a*, 918*b*. Rail 916 is configured to be slidably received within recess 910. This permits cover 912 to selectively cover and uncover an opening through end wall 906. A protrusion 920 on end wall 906 can mate with a corresponding recess 922 in cover 912 to restrain movement of cover 912 when attached to end wall 906. It will be appreciated that protrusion 920 and recess 922 can be reversed on cover 912 and end wall 906, respectively. At least an outer surface of cover 912 may comprise metal, such as steel or aluminum, in order to provide a hard hammering surface.

FIG. 9A is an exploded view of body 900 with cover 912 being detached from end wall 906. FIG. 9B shows cover 912 slidably attached to end wall 906, with locking engagement of protrusion 920 and recess 922. FIG. 9C shows how initially detached cover 912 can be placed over the opening through end wall 906 to enclose interior chamber 904 by slidably engaging rail 916 of cover 912 with recesses or channels 910 of end wall 906. When rail 916 is positioned within recesses 910, sidewalls 918*a*, 918*b* of rail 916 will lie adjacent to and in slidable contact with sidewalls 908*a*, 908*b* of end wall 906. When cover 912 is positioned so as to provide access through end wall 906 to interior chamber 904, weighting material can be selectively inserted into and removed from interior chamber 904. Positioning cover 912 relative to end wall 906 so as to block access to interior chamber 904 encloses weighting material within interior chamber 904 or conveniently keeps cover 912 in a non-intrusive position relative to end wall 906 when chamber 904 is empty. A flexible leash (not shown) can interconnect cover 912 and end wall 906 to prevent accidental loss. Cover 912 may include a slot, protrusion or other gripping structure (not shown) that can be engaged by a person's fingers, tool or coin when sliding stopper 912 relative to end wall 906. Detent features or stops (not shown) can be included to limit the extent that cover 912 can slide relative to end wall 906 (e.g., to prevent complete detachment of cover 912 from end wall 906).

The adjustable weight striking tools disclosed herein can be made from any appropriate material that can yield a tool that is lighter when unladen with weighting material. For example, they can include, in whole or in part, one or more of molded plastic (e.g., ABS, polystyrene, polyolefins (e.g., polyethylene and polypropylene), polyesters (e.g., PET, PETE, and PTFE), polyamides (e.g., nylon), PEEK, polyetheramides, polysulfones, polycarbonates, polyurethanes), molded or machined low density metal (e.g., aluminum, titanium, and low density alloys (i.e., specific gravity less than about 4.9, about 4.7, about 4.5, about 4.25, about 4, about 3.75, about 3.5, about 3.25 or about 3), and wood. Materials advantageously provide strength and durability where needed while maintaining low weight where possible. According to one embodiment, the material used to make at least part of the mallet can have a specific gravity less than about 3.0, 2.75, 2.5, 2.25, 2, 1.75, 1.5. 1.3, 1.2, or 1.1.

The handle and body can be integrally molded together, welded, or attached using other attachment means known in the art (e.g., threaded coupling, bayonette coupling, press fit, hinged, and the like). The handle and body may be connected together or adjustable so that they are substantially orthogonal to each other. The handle can have a first longitudinal axis and the body can have a second longitudinal access oriented relative to the first longitudinal axis by an angle in a range of about 70° to about 110°, or about 75° to about 105°, or about 80° to about 100°, or about 85° to about 95°, or about 87.5° to about 92.5° ("substantially orthogonal).

According to one embodiment, the handle and body are advantageously made from a rigid plastic material that has a Young's modulus of at least about 2 GPa, preferably at least about 2.5 GPa, more preferably at least about 3 GPa. Packing a hollow lightweight molded rigid plastic body with pebbles, sand or sand-water slurry so as to eliminate most or all air space (at least about 85%, 90%, 95%, 97.5% or 99%) can provide a synergistic interaction with the body by reducing or eliminating the tendency to deform, crack or shatter compared to when striking an object when empty. The combination of lightweight plastic and tightly packed weighting material yields a hollow body that is sufficiently durable as to withstand breaking while striking an object. In this way it is unnecessary, even undesirable, to construct the head primarily or entirely of a dense, heavy metal, such as steel or copper.

The wall thickness of the body can be thicker for hammering surfaces to prevent denting or breaking (e.g., from ¼ to ¾ inch). The side walls can be somewhat thinner (e.g., from ⅛ to ¼ inch) but should be sufficiently rigid to be not easily deformable when hammering an object. The use of strengthening ribs (e.g., that are ¼ to ¾ thick) can permit the use of thinner side walls while preventing deformation. This provides maximum strength and rigidity of the tool while minimizing weight.

According to one embodiment, the body and handle are integrally molded and/or machined as a single piece of material (e.g., plastic or lightweight metal alloy). An external platform, when included, may also to integrally formed with the body. The cover or closure means can be formed separately and attached to the body. At least the striking surface or edge of a striking tool can comprise a lightweight metal, such as strong titanium alloy. Alternatively, a thin and lightweight steel or titanium surface can be provided over an underlying polymer substrate on the outer striking tool surface to provide a harder surface and prevent damage to the striking tool.

The amount of weight that can be selectively added to an interior chamber of a hollow body or placed on an exterior platform depends on the volume of weighting material placed into the interior chamber and the bulk density of the weighting material. Materials with higher specific gravity may provide more weighting per unit volume. Sand, for example, has a specific gravity that is roughly three times that of water (i.e., 3 vs. 1). However, because there are spaces between sand grains, the bulk density of sand is only about 1½ times that of water (i.e., about 1.5 g/cm$^3$). It may be advantageous to fill the inter-particle spaces with water to maximize weight. For example, a cup (240 ml) of sand weighs approximately 12.5 ounces while a cup of water weighs approximately 8.4 ounces. Filling the interior chamber with one cup (240 ml) of sand will add about 50% more weight to the mallet head than one cup (240 ml) of water. However, filling the interior chamber with one cup (240 ml) of a sand-water slurry will add more weight than either sand or water alone.

The weight of one cup (240 ml) of sand is reportedly about 12.5 ounces (about 355 g). The weight of one cup (240 ml) of water is reportedly about 8.3 ounces (about 235 g). Assuming sand has a packing density of 50%, a cup (240 ml) of sand includes a half cup (120 ml) of inter-particle space that can be filled with water. That means that a cup (240 ml) of a sand-water slurry may weigh about 16½ ounces (about 475 g), or a little more than a pound. A half cup of sand-water slurry weighs about 8.3 ounces (about 235 g), or a little more than half a pound.

According to one embodiment, the interior chamber of a hollow body may be proportioned to provide a volume of at least about ½ cup (about 120 ml), at least about ¾ cup (about 180 ml), at least about 1 cup (about 240 ml), at least about 1.25 cup (about 300 ml), at least about 1.5 cup (about 360 ml), at least about 2 cups (about 475 ml), at least about 2.5 cups (about 600 ml), or at least about 3 cups (about 700 ml). To understand how size of a hollow body and interior volume can be adjusted to accommodate a desired volume of weighting material, reference can be made to the volume of a cylinder, which is $\pi r^2 h$, where r=radius and h=height of the cylinder. A first hypothetical cylinder having a diameter of 2 inches (r=1 inch) and height (h) of 4 inches will have a volume of 12.56 $in^3$. Since a cup has a volume of 14.65 $in^3$, the volume of the first hypothetical cylinder will be about 0.85 cup and will theoretically hold about 14 oz. (about 400 g) of sand-water slurry. By way of example, a cylindrical hollow body having an outer diameter wall thickness of ¼ inch can have an outer diameter of 2½ inches and a length of 4½ inches so as to define an interior cylindrical volume having a diameter of 2 inches and a height of 4 inches.

A second, slightly longer hypothetical cylinder having a diameter of 2 inches (r=1.1 inch) and height (h) of 4.5 inches will have a volume of 14.14 $in^3$, which will hold about a pound (about 450 g) of sand-water slurry. By way of example, a cylindrical hollow body having an outer diameter wall thickness of ¼ inch can have an outer diameter of 2½ inches and a length of 5 inches so as to define an interior cylindrical volume having a diameter of 2 inches and a height of 4.5 inches.

Figure 1:
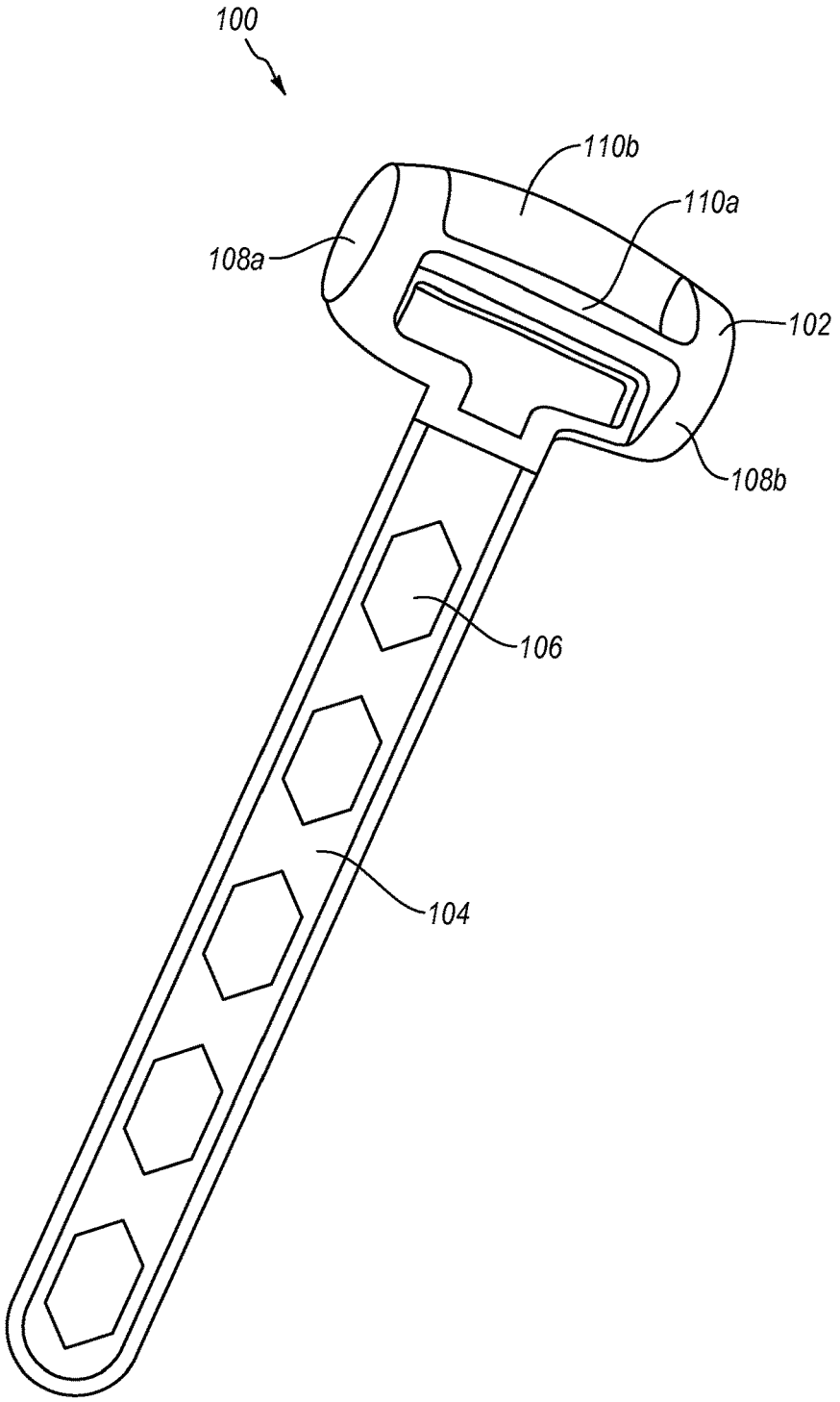
FIG. 1 (Prior Art)
FIG. 1 is a perspective view of a lightweight camping/backpacking mallet made from molded plastic.

By way of further example, for a lightweight mallet as in FIG. 1 having a total weight of 7.4 ounces (210 g), and assuming the head contributes 5 ounces (140 g) of weight, adding even ½ cup (120 ml) of sand-water slurry weighing 8.3 ounces (about 235 g) to an interior chamber of the hollow body will more than double the weight of the head or body (i.e., from 5 ounces to more than 13 ounces). Adding ¾ cup (180 ml) of sand-water slurry weighing 12.5 ounces (about 355 g) will more than triple the weight of the head or body (i.e., from 5 ounces to more than 17 ounces). Adding 1 cup (240 ml) of sand-water slurry weighing 16.7 ounces (about 475 g) will more than quadruple the weight of the head or body (i.e., from 5 ounces to more than 21 ounces). Doubling, tripling or quadrupling the weight will increase the striking power of the tool (defined as the momentum, or mass times the velocity) by a similar amount.

An advantage of an exterior platform instead of, or in addition to an interior chamber, is at least two-fold: (1) the size of weighting material is not constrained by the volume of an interior chamber and (2) a solid rock, brick or slab can be used, which can provide more weight because it is solid and contains no inter-particulate spaces like pebbles or sand. By way of reference, the weight of a standard red clay brick, 8 inches long, 4 inches wide, and 2¼ inches thick (20 cm×10 cm×5½ cm) is reportedly about 4.5 lbs (about 2 kg). A 6×6 inch paver was weighed by the inventor and determined to weigh about 6.5 lbs (about 3 kg). Stacking two of such bricks to a device that weighed 2 pounds would increase its weight to 15 pounds, a 7.5-fold increase. In the wild, a flattened rock that is about 6 inches wide and 4 inches thick might weigh about 12-20 pounds. Much smaller rocks can be used and still achieve a substantial weight increase. For a striking tool that initially weighs 8 ounces when unladen, it would be easily to increase the weight to 2 pounds, 4 pounds, 6 pounds, 8 pounds, or 10 pounds or more by selecting and attaching one or more appropriately size rocks to an external platform. If an interior volume is filled with pebbles or sand, the weight increase can be greater.

According to one embodiment, lightweight adjustable weight tools as disclosed herein can weigh less than about 3 pounds (about 1360 g), less than about 2.5 pounds (about 1135 g), less than about 2 pounds (about 910 g), less than about 1.5 pound (about 680 g), less than about 1.25 pound (about 567 g), less than about 16 ounces (about 455 g), less than about 14 ounces (about 400 g), less than about 12 ounces (about 340 g), less than about 10 ounces (about 285 g), less than about 8 ounces (about 225 g) when unladen with weighting material. The weight can be increased using a weighting by at least about 50%, 100%, 150%, 200%, 300%, 400% or 500% depending on the relative amount of weighting material that is used.

In a method of adjusting the weight of an adjustable weight tool as disclosed herein, the body can have an initial weight when unladen with weighting material. In the case of a body with interior chamber, access can be provided to the interior chamber by at least partially removing a cover over an access opening. The user then places weighting material into the interior chamber, such as rocks, pebbles, sand, dirt, water, or other materials that can fit in the interior chamber. Alternatively, or in addition, to filling an interior chamber (i.e., internal platform) with weighting material, a rock, brick or slab can be attached to an external platform.

According to one embodiment, the weighting material increases the weight of the tool by at least about 50% relative to the initial weight, or at least about 75%, or at least about 100%, or at least about 125%, or at least about 150%, at least about 200%, at least about 250%, at least about 300%, at least about 350%, at least about 400%, or at least about 500%. According to one embodiment, the density and/or bulk density of weighting material placed into an interior chamber and/or onto an external platform can be at least about 1 $g/cm^3$, 1.25 $g/cm^3$, 1.5 $g/cm^3$, 1.75 $g/cm^3$, 2 $g/cm^3$, 2.25 $g/cm^3$, 2.5 $g/cm^3$, 2.75 $g/cm^3$, 3 $g/cm^3$, or 3.5 $g/cm^3$.

Additional aspects of the invention are shown or may be extrapolated from the sketches also submitted herewith, which show additional aspects of striking tools and structure for attachment of striking tools to a head or body. In addition, additional aspects of how a rock or slab may be releasably attached to a platform rigidly attached to a body (e.g., hollow body) are schematically illustrated in the sketches.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable weight striking device, comprising:

a body comprising a material having a density less than about 4.9 g/cm3 and having a working end and a second end opposite the working end;

a handle extending laterally from the body at a location between the working end and the second end of the body and comprising a material having a density less than about 4.9 $g/cm^3$;

a striking tool disposed at the working end of the body, the striking tool having a maximum width;

a platform forming the second end of the body, the platform having a perimeter region and center region that does not protrude beyond the perimeter region to facilitate placement thereon of a weighting material that covers and extends outwardly from at least the center region of the platform in order to temporarily increase the weight of the device and increase striking force during use, wherein the platform has a width greater than the width of the striking tool to facilitate placement on the platform of the weighting material having a width greater than the width of the striking tool; and further comprising one or more flexible straps fastened at one end to the platform.

2. An adjustable weight striking device as in claim 1, wherein the body and handle both comprise at least one polymer having a density less than about 2 g/cm$^3$.

3. An adjustable weight striking device as in claim 1, wherein the body and handle comprise a lightweight metal or metal alloy having a density less than about 4.9 g/cm$^3$.

4. An adjustable weight striking device as in claim 1, wherein the striking tool has a striking surface that is flat, curved or pointed.

5. An adjustable weight striking device as in claim 4, wherein the striking surface provides functionality of a mallet, hammer, sledge hammer, pick, hatchet, or axe.

6. An adjustable weight striking device as in claim 4, wherein the striking tool comprises a lightweight metal or metal alloy having a density less than about 4.9 g/cm$^3$.

7. An adjustable weight striking device as in claim 6, wherein the striking tool comprises a titanium alloy having a density in a range of about 4.45 g/cm$^3$ to about 4.82 g/cm$^3$.

8. An adjustable weight striking device as in claim 1, wherein the body includes an interior chamber extending from the working end to the second end.

9. An adjustable weight striking device as in claim 8, further comprising an opening through the platform for selectively inserting additional weighting material into and removing the additional weighting material from the interior chamber.

10. An adjustable weight striking device as in claim 1, wherein the one or more flexible straps can be wrapped around the weighting material on top of the platform and include one or more locks or clasps for securing the one or more straps during use and loosening the one or more straps to permit removal of the weighting material from the platform.

11. An adjustable weight striking device as in claim 1, wherein the body comprises an interior chamber within the body and an opening through the body.

12. An adjustable weight striking device as in claim 1, wherein the striking tool is removably attachable to the working end of the body.

13. An adjustable weight striking device as in claim 12, wherein the working end includes at least one slot, channel or recess formed therein and the striking tool includes at least one flange, rail or ridge that corresponds to and mates with the at least one slot, channel or recess for removably attaching the striking tool to the working end.

14. An adjustable weight striking device as in claim 12, wherein the working end includes at least one flange, rail or ridge formed therein and the striking tool includes at least slot, channel or recess that corresponds to and mates with the at least one flange, rail or ridge for removably attaching the striking tool to the working end.

15. An adjustable weight striking device as in claim 1, wherein the adjustable weight striking device weighs less than about 1.5 pound when the striking device is devoid of weighting material.

16. An adjustable weight striking device, comprising:

a body comprising a material having a density less than about 4.9 g/cm$^3$ and extending along a longitudinal axis between a working end and a second end opposite the working end;

a handle extending laterally from the body at a location between the working end and the second end of the body and comprising a material having a density less than about 4.9 g/cm$^3$;

a plurality of selectively attachable and removable striking tools configured for selective attachment to and removal from the working end of the body, wherein each selectively attachable and removable striking tool has a striking surface that is flat, curved or pointed;

a platform at the second end of the body and having an external surface transverse to the longitudinal axis of the body and facing away from the working end of the body, the platform having a perimeter region and a center region that does not protrude beyond the perimeter region; and one or more straps configured to temporarily secure one or more weighting objects to the external surface of the platform so as to cover and extend outwardly from at least the center region of the platform wherein the one or more straps are fastened at one end to the platform.

17. An adjustable weight striking device as in claim 16, wherein the striking surfaces of the striking tools provide one of a functionality of a mallet, hammer, sledge hammer, pick, hatchet, or axe.

18. An adjustable weight striking device as in claim 16, wherein the one or more straps or other fasteners are attached to the platform and moveable to selectively secure or release one or more weighting objects.

19. An adjustable weight striking device, comprising:

a body comprising a material having a density less than about 4.9 g/cm$^3$ and extending along a longitudinal axis between a working end and a second end opposite the striking end;

a handle comprising a material having a density less than about 4.9 g/cm$^3$ and extending laterally from the body at a location between the working end and the second end of the body;

a striking tool disposed at the working end of the body;

a platform at the second end of the body, the platform having an external surface that is substantially flat and devoid of a central protrusion, that is transverse to the longitudinal axis of the body, and that faces away from the striking tool for placement of weighting material on the external surface; and further comprising one or more flexible straps fastened at one end to the platform.

* * * * *